United States Patent [19]

Bondoc et al.

[11] 4,200,487

[45] Apr. 29, 1980

[54] ECONOMICAL METHOD OF MAKING HIGH-STRENGTH GLASS FIBER MATS PARTICULARLY USEFUL FOR ROOFING PRODUCTS

[75] Inventors: Alfredo A. Bondoc, Middlesex; V. Robert Canfield, Martinsville; B. Randall Ziegler, Freehold, all of N.J.

[73] Assignee: GAF Corporation, New York, N.Y.

[21] Appl. No.: 39,578

[22] Filed: May 16, 1979

[51] Int. Cl.[2] ..... D21F 11/00

[52] U.S. Cl. ..... 162/135; 162/156

[58] Field of Search ..... 162/145, 156, 135, 183, 162/184; 428/288, 297, 302; 427/384

[56] References Cited

U.S. PATENT DOCUMENTS

| | | | |
|---|---|---|---|
| 2,747,994 | 5/1956 | Hoopes | 162/156 |
| 2,859,109 | 11/1958 | Hawley et al. | 162/145 |
| 3,766,003 | 10/1973 | Schuller et al. | 162/156 |
| 4,112,174 | 9/1978 | Hannes et al. | 428/297 |

*Primary Examiner*—S. Leon Bashore
*Assistant Examiner*—Peter Chin
*Attorney, Agent, or Firm*—Walter C. Kehm; Walter Katz

[57] ABSTRACT

The glass mat made herein is comprised of two fibrous components, namely, individual filament glass fibers and extended glass fiber elements. These components are formed herein in situ in a wet-laid process from original bundles of glass fibers. The individual filaments appear by conventional filamentation of the bundles. The extended fiber elements, however, are formed by longitudinal extension of a given bundle whose fibers are connected longitudinally. Thereby the effective length of a fiber element is very much greater than the length of the fibers therein. The fiber elements are further characterized by a non-uniform diameter, as contrasted to the fibers themselves, being thicker in the midsection of the element where connection of fibers is maximized, and tapered towards its ends, where fiber connection is at a minimum.

The extended fiber elements preferably predominate by weight of the fibrous content of the mat over the individual filaments. The desired ratio of the two components is achieved in the method of the invention by using bundles whose fibers have a long length, and by very gentle agitation of the dispersion slurry for a short period of time.

13 Claims, No Drawings

ECONOMICAL METHOD OF MAKING HIGH-STRENGTH GLASS FIBER MATS PARTICULARLY USEFUL FOR ROOFING PRODUCTS

BACKGROUND OF THE INVENTION

1. Field of the Invention

This invention relates to a wet-laid method of making glass fiber mats, and more particularly, to an improved process for making high-strength glass fiber mats which are particularly useful for roofing products, including built up roofing membranes and systems.

2. Description of the Prior Art

Roofing products which use glass fiber mats in place of organic felts require mats having high-strength properties. Built up roofing membranes and systems, especially, need mats which have excellent tear resistance. Unfortunately, the glass fiber mats of the prior art, which rely upon continuous strands or elongated, rod-like bundles of fibers as reinforcing agents, often are expensive and more difficult to make, and do not possess these high-strength properties, particularly for built up roofing application. Such glass mats are described in a number of U.S. Pat. Nos., including 3,634,054; 3,853,683; 4,112,174; 4,129,674; 4,135,022 and 4,135,029.

Therefore, it would be of considerable advantage to the roofing industry to provide a new and improved method of making high-strength glass fiber mats adaptable for built up roofing membranes and systems, by an economical, wet-laid process using inexpensive, chopped bundles of glass fibers as the raw material for the mat.

RELATED COPENDING PATENT APPLICATIONS (a) U.S. patent application, Ser. No. 851,683, filed Nov. 15, 1977 (FDN-1062), assigned to the same assignee as herein, describes a process of making uniform glass filament mats from an aqueous dispersion composition formed from bundles of glass fibers and a tertiary amine oxide dispersant.

(b) U.S. patent application, Ser. No. 039,577, filed concurrently herewith (FDN-1193) by the same named inventors, and assigned to the same assignee as this invention, claims the high-strength glass fiber mat structure made herein.

(c) U.S. patent application, Ser. No. 039,575, filed concurrently herewith, (FDN-1193/A), by the same named inventors, and assigned to the same assignee, as this invention, claims high-strength built up roofing membranes and systems using a high-strength glass fiber mat structure.

SUMMARY OF THE INVENTION

What is provided herein is an economical method of making high-strength glass fiber mats having a novel structure and high-strength properties, which are particularly useful for roofing products, including built up roofing membranes and systems.

The glass mat made herein is comprised of two fibrous components, namely, individual filament glass fibers and extended glass fiber elements. These components are formed herein in situ in a wet-laid process from original bundles of glass fibers. The individual filaments appear by conventional filamentation of the bundles. The extended fiber elements, however, are formed by longitudinal extension of a given bundle whose fibers are connected longitudinally. Thereby the effective length of a fiber element is very much greater than the length of the fibers therein. The fiber elements are further characterized by a non-uniform diameter, as contrasted to the fibers themselves, being thicker in the midsection of the element where connection of fibers is maximized, and tapered towards its ends, where fiber connection is at a minimum.

The extended fiber elements preferably predominate by weight of the fibrous content of the mat over the individual filaments. The desired ratio of the two components is achieved in the method of the invention by using bundles whose fibers have a long length, and by very gentle agitation of the dispersion slurry for a short period of time.

DETAILED DESCRIPTION OF THE INVENTION

The high-strength glass fiber mat structure made by the method of the invention is comprised of two fibrous components namely, a plurality of conventional individual glass filaments fibers and a plurality of unusual extended glass fiber elements (described below) both of which are substantially randomly oriented and uniformly dispersed throughout the mat.

In the wet-laid process of the invention chopped bundles of glass fibers of rather long length (described later) are added to an aqueous solution of a suitable dispersant in a mixing tank. Each bundle contains many fibers, often between 20 to 300, or more, fibers per bundle. The fibers in these bundles may be sized or unsized, wet or dry, as long as they can be suitably dispersed in the aqueous dispersant medium.

The mixture of fiber bundles in the aqueous dispersement medium then is agitated very gently to form a dilute fiber slurry of selected consistency. During this agitation, some of the fibers in the bundles become filamentized, i.e. form individual filaments. The remaining fibers in a partially filamentized bundle (or fibers in an original unfilamentized bundle) then slide apart and become connected longitudinally to form an extended glass fiber element. These fiber elements thereby have an effective length which exceeds that of the fibers themselves within the element. The diameter, of a fiber element, also is non-uniform, as contrasted to the fibers therein, being greater in the middle portion thereof, where connection of fibers is greatest, than at its ends where connection of fibers is at a minimum. Thus the fiber elements taper outwardly from the middle towards each end portion thereof.

A single source of fiber bundles having the same physical and chemical properties, including length, diameter, sizing, electrical characteristics, etc. may be used in the process of forming the glass mats of the invention. Less preferably, however, bundles with fibers of differing dimensions may be used. The feature of being able to use one starting material makes the process very economical.

The extended fiber elements of the glass mat contribute substantially to the high-strength properties of the mat while the individual filaments provide the uniform denseness necessary for impregnation of asphalt in the manufacture of roofing products. Accordingly, the individual filaments suitably are present in the glass mat in an amount of about 20% to 60% by weight of the total fibrous material, while the extended fiber elements comprise about 40% to 80%. Preferably, however, the individual filaments comprise only about 30% to 50% by weight of the mat and the fiber elements about 50% to 70%. In the best mode, the individual filaments constitute 40% and the extended fiber elements predominate at about 60% of the mat.

The glass fibers in the bundles are selected to have a relatively long length, suitably, about 1¾ to 3 inches, preferably about 2 to 2½ inches, and optimally, 2¼ inches in length. The use of longer fibers provides more fiber elements in the mat at the expense of individual filaments for a given degree of agitation. The diameter of the fibers is not a critical parameter. For practical reasons, however, commercial fibers have a diameter of about 8 to 20 microns, and, preferably about 12 to 19 microns are used.

Mild agitation of the dispersion slurry for short periods of time favors the formation of the desired ratio of individual filaments to extended fiber elements. Clearly, the intense agitation normally employed in wet-laid processes for making uniform glass mats is not used here. Such agitation forms highly filamentized glass mats from fiber bundles which do not contain the substantial amount of fiber elements which are an essential part of the mat of this invention. However, conventional mixing equipment using propellor driven stirrers may be utilized as long as agitation is carried out at relatively low propeller speeds and for short periods of time. Usually, for a 4 liter slurry, which is used to make hand sheets, for example, about 1.5 watt-hour of energy is applied for each 5 minutes of agitation. Usually agitation is continued for less than 30 minutes, and preferably for only about 5 to 15 minutes. In commercial equipment, mild agitation for short periods of time is used also. The process preferably is run in a continuous manner, rather than in a batch operation.

Any suitable dispersant material may be used to form the fiber dispersion slurry. Many such dispersants are known in the art and are available for this purpose. However, a particularly useful dispersant is a tertiary amine oxide, such as Aromox DMHT, which is dimethyl hydrogenated tallow amine oxide, sold by Armak Chemical Co., and described in the aforementioned copending application. This dispersant suitably is used in a concentration of about 2 to 100 ppm, preferably about 5 to 30 ppm, and, optimally, about 10 ppm, of the fiber slurry.

The dispersion slurry suitably is maintained at a dispersion consistency of about 0.1 to 2% by weight of the fibers in the slurry, preferably about 0.2 to 1%, and, optimally, about 0.5%. As in the usual wet-laid processes, the concentrated dispersion slurry is diluted with water before being applied to the mat-forming screen. Preferably the dispersion slurry is diluted about 5 to 25 times at the screen, and, optimally, about 10 times. Generally, higher dispersion and formation consistencies favor generation of extended fiber elements at the expense of individual filaments.

The glass mat thus-formed then is provided with a suitable binder to hold the fibrous components together. Any commercially available binder may be used, such as urea-formaldehyde or phenol-formaldehyde resins. The binder usually is applied in an amount of about 3 to 45% by weight of the finished mat, preferably about 10 to 30%, and, optimally, about 15 to 20%. Generally, too much binder decreases the porosity of the mat to an unsuitable condition, whereas too little binder diminishes the integrity of the mat unreasonably.

Suitably the basis weight of the finished mat (with binder) should be at least 1 lb/100 sq. ft. (49 g/sq.m.), and, preferably, about 2.0% to 3.0 lbs/100 sq. ft. (98 to 148 g/sq.m.)

The glass mats of the invention also are characterized by very high-strength properties. Generally, the mats have an Elmendorf tear strength of about 8 Newtons at a basis weight of 98 g/sq.m. In application in three-ply asphaltic built up roofing systems, such mats provide products having a tensile strength of about 235 lbs/inch (CMD) at 0° F.

The following Examples will further illustrate the invention.

PREPARATION OF GLASS MAT BY METHOD OF THE INVENTION

A. Laboratory Equipment

Example 1

A quantity of sized, wet chopped strand fiber, 2 inches in length, 16 mm. in diameter, weighing 3 g. on a dry basis, was added to 4 l. of water containing 20 ppm of Aromox DMHT. The resulting slurry was agitated with a Lightning mixer equipped with a propeller type stirrer set at abouit 400 rpm for periods of 5, 10 and 20 minutes. The thus-agitated dispersion slurry composition then was drained through a wire mesh upon which the glass mat was formed. After drying, a ureaformaldehyde binder was applied to form a finished mat having a basis weight of 98 g/sq.m. The resultant glass mat hand sheets had 20%, 35% and 55% individual filaments, and 80% 65% and 45% extended fiber elements for the 5, 10 and 20 minutes of agitation, respectively.

B. Commercial Equipment

Example 2

60 kg of K filament, sized, wet chopped strand, 2 inch glass fibers were fed into an 80 cubic meter tank filled with an aqueous solution containing 10 ppm. of Aromox DMHT. The filter consistency in the stock solution was 0.4%. The tank was cylindrical, upright, having a diameter of 5 meters, and was equipped with a side entering 3-blade propellor agitator. The blades have a variable slope angle normally set at about 15° to 18°, circular in shape, being about 200 to 250 mm. at the widest point and having rounded, dull edges. The propeller measures about 1300 mm in diameter and was mounted on a shaft about 200 to 250 mm. in diameter, driven by a motor at about 80 to 120 rpm. The stock was agitated for about 5 minutes; the energy input was about 0.6 kw-hr. for this period of agitation.

The agitated stock then was pumped to a mat-forming machine. Enroute the stock was diluted in a tank with water containing 10 ppm. of Aromox DMHT to a formation consistency of 0.04%. Thereafter, the mat thus-formed was impregnated with a urea-formaldehyde binder, dried and cured. The resultant mat contains about 20% binder and 80% fibrous material having a basis weight of 100 g/sq.m. The fibrous components of the mat comprises about 60% by weight of extended fiber elements and about 40% by weight of substantially individual filaments.

The process described above was run continuously be feeding fiber bundles at a rate of 60 kg. per minute. The average residence time of the fibers in the tank was about 5 minutes. Water removed at the mat-forming machine was recycled to the dilution tank (9 parts) and to the mixing tank (1 part). Thus, the process was operated in a closed loop, continuous manner.

What is claimed is:

1. A method of making high-strength glass fiber mats comprising a plurality of individual filament glass fibers comprising about 20% to 60% by weight of the fibrous material in said mat, and a plurality of extended glass fiber elements comprised of longitudinally connected fibers said elements there having a length which is greater than the length of the fibers in said element, and a diameter which is nonuniform, being greater in the mid-portion thereof than at its ends, said elements comprising about 40% to 80% by weight of the fibrous material in said mat, both said individual filament fibers and said extended fiber elements being substantially randomly oriented and uniformly dispersed throughout said material, and having a binder substance therein to hold said fibrous material together which comprises the steps of:

(a) forming an aqueous slurry of bundles of glass fiber having a length of about 1¾ to 3 inches and a diameter of about 8 to 20 microns and a dispersant, (b) gently agitating said slurry to disperse said bundles into said individual filaments and extended fiber elements, (c) passing said thus agitated dispersion slurry onto a mat-forming screen to form said fibrous mat and removing water therefrom and, (d) applying a binder to said mat.

2. A method according to claim 1 wherein said individual filaments comprise about 30% to 50%, and said extended fiber elements about 50% to 70%, by weight of the fibrous material in said mat.

3. A method according to claim 1 wherein said individual filaments comprise about 40%, and said extended fiber elements about 60%, by weight of the fibrous material in said mat.

4. A method according to claim 1 wherein the fibers in said bundles have a length of about 2 to 2½ inches.

5. A method according to claim 1 wherein a single source of bundles are used containing fibers having the same length and diameter.

6. A method according to claim 1 wherein said dispersant is present in an amount of about 2 to 100 ppm of said slurry.

7. A method according to claim 1 wherein said dispersant is present in an amount of about 5 to 30 ppm.

8. A method according to claim 1 wherein said dispersant is a tertiary amine oxide.

9. A method according to claim 1 wherein the fiber slurry consistency is about 0.1 to 2% by weight of the fibers.

10. A method according to claim 9 wherein said fiber consistency is about 0.2 to 1%.

11. A method according to claim 1 wherein said process is run continuously, with fiber bundles being fed at a uniform rate to form the fiber slurry, and water which is removed from said screen being recycled both for dilution water and for formation of the aqueous slurry.

12. A method according to claim 1 wherein the slurry is agitated for about 5 minutes.

13. A method according to claim 12 in which the energy input is about 0.6 kw-hr. for 5 minutes of agitation of an 80 cubic meter slurry.

* * * * *

UNITED STATES PATENT AND TRADEMARK OFFICE

CERTIFICATE OF CORRECTION

PATENT NO. : 4,200,487

DATED : April 29, 1980

INVENTOR(S) : Alfredo Bondoc et al

It is certified that error appears in the above—identified patent and that said Letters Patent is hereby corrected as shown below:

In Column 4, line 3, for "%" read ---lbs---.

line 21, for "mm." read ---microns---.

line 41, for "filter" read ---fiber---.

line 64, for "be" read ---by---.

Signed and Sealed this

*Sixteenth* Day of *September 1980*

[SEAL]

*Attest:*

SIDNEY A. DIAMOND

*Attesting Officer*

*Commissioner of Patents and Trademarks*